US006362859B1

(12) United States Patent
Hagiwara et al.

(10) Patent No.: US 6,362,859 B1
(45) Date of Patent: Mar. 26, 2002

(54) ELECTROSTATIC INK JET RECORDING HEAD HAVING ELECTROPHORETIC ELECTRODE AND GRAVITY INK RESERVOIR

(75) Inventors: Yoshihiro Hagiwara; Ryosuke Uematsu; Junichi Suetsugu; Hitoshi Minemoto; Kazuo Shima, all of Tokyo (JP)

(73) Assignee: NEC Corporation, Tokyo (JP)

( * ) Notice: Subject to any disclaimer, the term of this patent is extended or adjusted under 35 U.S.C. 154(b) by 670 days.

(21) Appl. No.: 08/758,369

(22) Filed: Nov. 29, 1996

(30) Foreign Application Priority Data

Dec. 11, 1995 (JP) ..... 7-321680

(51) Int. Cl.[7] ..... B41J 2/06
(52) U.S. Cl. ..... 349/55
(58) Field of Search ..... 347/89, 55, 112, 347/141, 92

(56) References Cited

U.S. PATENT DOCUMENTS 4,432,003 A 2/1984 Barbero et al. ..... 347/55
5,189,438 A * 2/1993 Hine et al. ..... 347/89

FOREIGN PATENT DOCUMENTS

| | | | |
|---|---|---|---|
| JP | 60250962 | * 12/1985 | ..... 347/55 |
| JP | 61-035254 | 2/1986 | |
| JP | 61-057343 | 3/1986 | |
| JP | 5-185600 | 7/1993 | |
| JP | 5-261936 | 10/1993 | |
| WO | WO 93/11866 | 6/1993 | |

* cited by examiner

*Primary Examiner*—Benjamin R. Fuller
*Assistant Examiner*—C. Dickens
(74) *Attorney, Agent, or Firm*—Sughrue Mion, PLLC

(57) ABSTRACT

An electrostatic ink jet recording head of a drop-on-demand type has a head body defining an ink chamber for receiving liquid ink containing charged toner particles, a set of electrodes for migrating the liquid ink by electrophoresis and ejecting the liquid ink from an ejecting slit of the ink chamber, and an ink reservoir, disposed above the ink chamber, for circulating the liquid ink by gravity between the ink reservoir and the ink chamber. A flow resistance against the liquid ink in the flow path from the outlet port of the ink chamber to the ink reservoir is smaller than a meniscus force generated by meniscuses formed at the ejecting slit to effectively eject the liquid ink without a pump and without an ink leakage.

4 Claims, 4 Drawing Sheets

ELECTROSTATIC INK JET RECORDING HEAD HAVING ELECTROPHORETIC ELECTRODE AND GRAVITY INK RESERVOIR

BACKGROUND OF THE INVENTION (a) Field of the Invention

The present invention relates to an electrostatic ink jet recording head and, in particular, to an ink jet recording head assembly using a liquid ink containing charged toner particles in an insulating solvent.

(b) Description of the Related Art

In a conventional ink jet recording head wherein ink is used as a recording material, the technique for supplying the liquid ink is categorized in two techniques. In the first technique, the amount of ink dissipated from an ink chamber as a result of the ejection is replenished from an ink reservoir by utilizing a meniscus force formed at an ejecting portion of the head body without using a pump. In this technique, the ink flows from the ink reservoir to the ink chamber without circulation.

With the first technique as generally adopted in a drop-on-demand type, since the ink ejection depends on the action of the meniscus force, there is a problem that a sufficient amount of toner particles cannot be replenished into the solvent which fills the ink chamber.

The second technique utilizes a pump for supplying the ink from the ink reservoir to a head body. This technique is employed in an ink jet recording head of a continuous type described in Patent Publications No. JP-A-5(1993)-261,936 and JP-A-5(1993)-185,600, for example. In this technique, the liquid ink is driven, as by a pump, to flow in one direction from the ink reservoir to the ink chamber, and the ink entering the ink chamber forces the preceding ink which has been present in the ink chamber back to the ink reservoir, thereby achieving a circulation of the ink between the ink reservoir and ink chamber.

Recently, an electrostatic ink jet recording head is developed in which a record is produced by using an ink containing charged toner particles dispersed in an insulating solvent. With an ink jet recording head of this type, a drop-on-demand technique is generally used in which charged toner particles in the solvent are subject to an electric field to be ejected from the surface of the meniscus, thereby producing a record on a recording medium. While the ink droplet is accompanied by a minimal amount of solvent, it is substantially composed of a cluster of toner particles. On the other hand, during the time interval when the ejection of the ink does not take place, the solvent is retained within the ink chamber by the surface tension produced by the meniscus formed at the ink ejecting portion.

In an ink jet recording head of the type described above, the toner in the solvent continues to be dissipated as the toner ejection continues, and hence the concentration of the toner decreases gradually in the ink. As a result, the amount of toner concentrated or collected at the ink ejecting portion decreases, with the consequence of a reduction in the amount of toner ejection, which in turn results in a small diameter of printed dots and a reduction in the printing density. If the ejection is further continued, the recording operation is not effected even though the ink chamber is filled with the solvent. Accordingly, in the recording head of this type, it is necessary to provide a fresh ink from the ink reservoir to the ink chamber to maintain the toner concentration in the solvent.

In the second technique, the ink ejection depends on the driving pressure by the pump to produce an ink flow. Hence, the technique is inadequate for use with the electrostatic ink jet recording head because the ink meniscus formed in the ink ejecting portion cannot be maintained at a high ink pressure within the ink chamber, causing an ink leakage from the ejecting portion. Further, since the second technique requires a pump for providing the ink circulation, it is difficult to obtain a compact size of the device, a reduction in manufacturing costs and an easy maintenance.

SUMMARY OF THE INVENTION

It is an object of the invention to provide an electrostatic ink jet recording head of the drop-on-demand type, wherein a reduction in the amount of toner contained in the solvent is effectively replenished in the ink chamber to assure that a stabilized printing operation be maintained to produce an excellent record.

The present invention provides an electrostatic ink jet recording head comprising: a head body defining an ink chamber for receiving liquid ink containing charged toner particles, the ink chamber having an inlet port disposed in the vicinity of a front end of the ink chamber, an outlet port disposed in the vicinity of a rear end of the ink chamber, and an ink ejecting slit, extending along the front end of the ink chamber, for ejecting the ink therethrough; a set of electrodes for ejecting toner particles from the ink chamber, the set of electrodes including a plurality of ink ejection electrodes arranged within the ink chamber along the ink ejecting slit, an electrophoretic electrode disposed within the ink chamber and opposed to tips of the plurality of ink ejection electrodes with an intervention of the ink inlet port, and an opposing electrode disposed outside the ink chamber and opposed to the tips of the plurality of ink ejection electrodes; and an ink reservoir, disposed above the ink chamber and connected to the ink inlet port and outlet port, for providing the liquid ink by gravity to the ink chamber through the inlet port and for receiving the liquid ink from the ink chamber through the outlet port.

In accordance with an embodiment of the invention, a voltage of the same polarity as the charged toner particles dispersed in the liquid ink is applied to the electrophoretic electrode to migrate the toner particles by electrophoresis, whereby the toner particles are collected or concentrated in the ink ejecting portion of the head body to form convex ink meniscuses. When a designed voltage pulse of the same polarity as the toner particles is applied to at least one of the ejection electrodes, a cluster of toner is ejected from the ink chamber. The toner particles thus dissipated by the ejection are replenished at any time from the other portion of the ink chamber under the influence of an electric field provided by the electrophoretic electrode and from the ink reservoir through the ink inlet port.

Specifically in the present invention, the ink toner is replenished from the ink reservoir by gravity without a pump so that the power dissipation of the ink jet recording head is reduced while achieving a compact size of the head and a reduction in manufacturing costs, without the necessity of a pump maintenance.

It is preferable to select a flow resistance against the ink in the flow path from the ink outlet port to the ink reservoir be lower than the ink meniscus force in order to allow the ink in the chamber to return through the outlet port and to receive new liquid ink from the ink reservoir, substantially without an ink leakage from the ink ejecting slit.

The above and other objects, features and advantages of the present invention will be more apparent from the following description, referring to the accompanying drawings.

DESCRIPTION OF THE PREFERRED EMBODIMENT

Referring to FIGS. 1 to 4, a preferred embodiment of the invention will be described.

Figure 1:
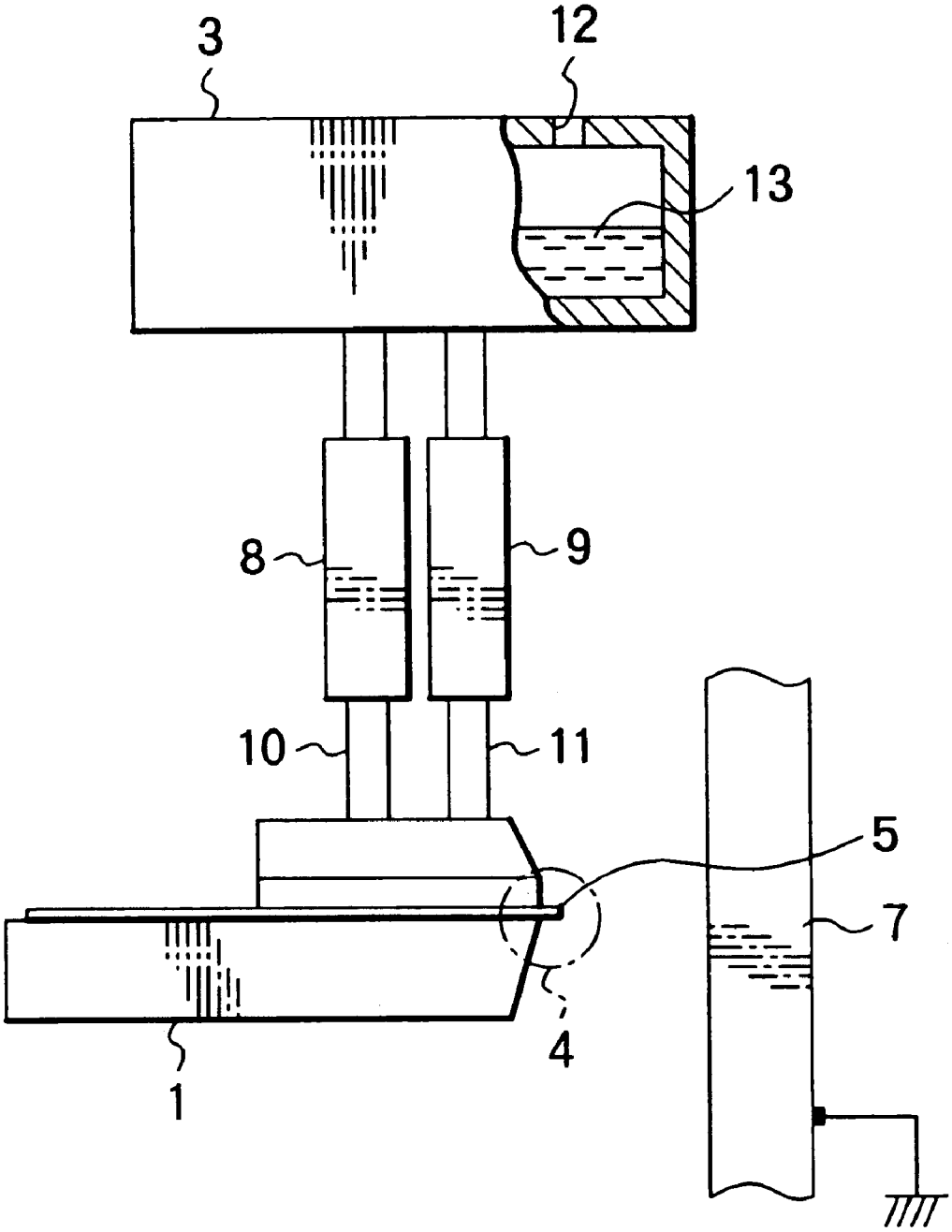
FIG. 1 is a schematic side view showing the general arrangement of an electrostatic ink jet recording head according to an embodiment of the invention.
Figure 2:
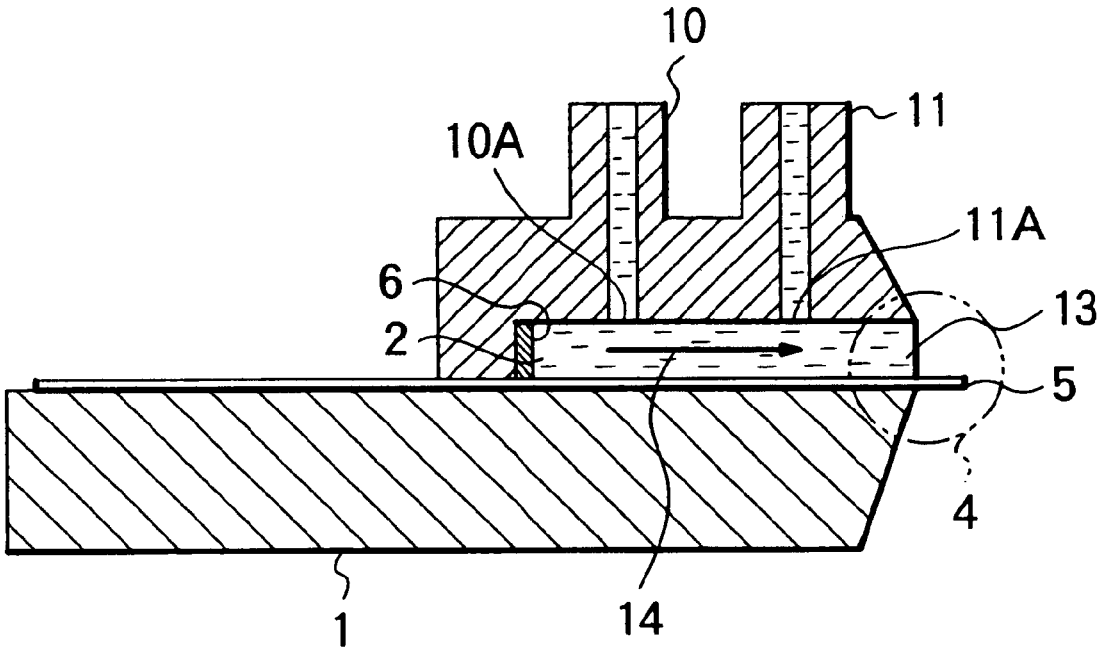
FIG. 2 is a longitudinal sectional view of the head body shown in the ink jet recording head of FIG. 1.

The electrostatic ink jet recording head shown in FIGS. 1 and 2 includes a head body 1, an ink reservoir 3, ink inlet tube 8, an ink outlet tube 9, and an opposing electrode 7. The head body 1 has therein an ink chamber 2 for receiving a certain amount of ink 13 containing charged toner particles, and an ink ejecting portion 4 formed as an ejecting slit at the front end of the ink chamber 2.

A plurality of elongate ink ejection electrodes 5 each having a tip in the ink ejecting portion 4 of the head body 1 are disposed in the ink chamber 2, extending in the direction from the ejecting portion 4 to the rear edge of the head body 1, where a driving voltage is applied to the ejection electrodes 5. The tips of the ink ejection electrodes 5 are arranged in a row along the front edge of the head body 1. An electrophoretic electrode 6 is disposed at the rear end of the ink chamber 2 and insulated from the ink ejection electrodes 5. The opposing electrode 7 is grounded and disposed opposite to the ink ejecting portion 4 with a recording medium interposed therebetween. An inlet connector 10 having an ink inlet port 10A is formed at the top of the head body 1 and connected to one of the ends of the ink inlet tube 8.

The ink inlet port 10A is disposed in the vicinity of the rear end of the ink chamber 2 near the electrophoretic electrode 6. An outlet connector 11 having an ink outlet port 11A is formed on the top of the head body 1 and connected to one of the ends of the ink outlet tube 9. The ink outlet port 11A is disposed in the vicinity of the front end of the ink chamber 2 near the ink ejecting portion 4.

The other ends of the ink inlet tube 8 and outlet tube 9 are connected to the ink supply connector and ink return connector, respectively, of the ink reservoir 3, both formed at the bottom of the reservoir 3. It is to be noted that the flow resistance of the outlet tube 9 against the ink flow is selected such that the flow resistance in the flow path from the ink outlet port 11A to the ink reservoir 3 is lower in magnitude than the meniscus force 16 of the ink meniscuses formed at the ink ejecting portion 4.

Figure 4:
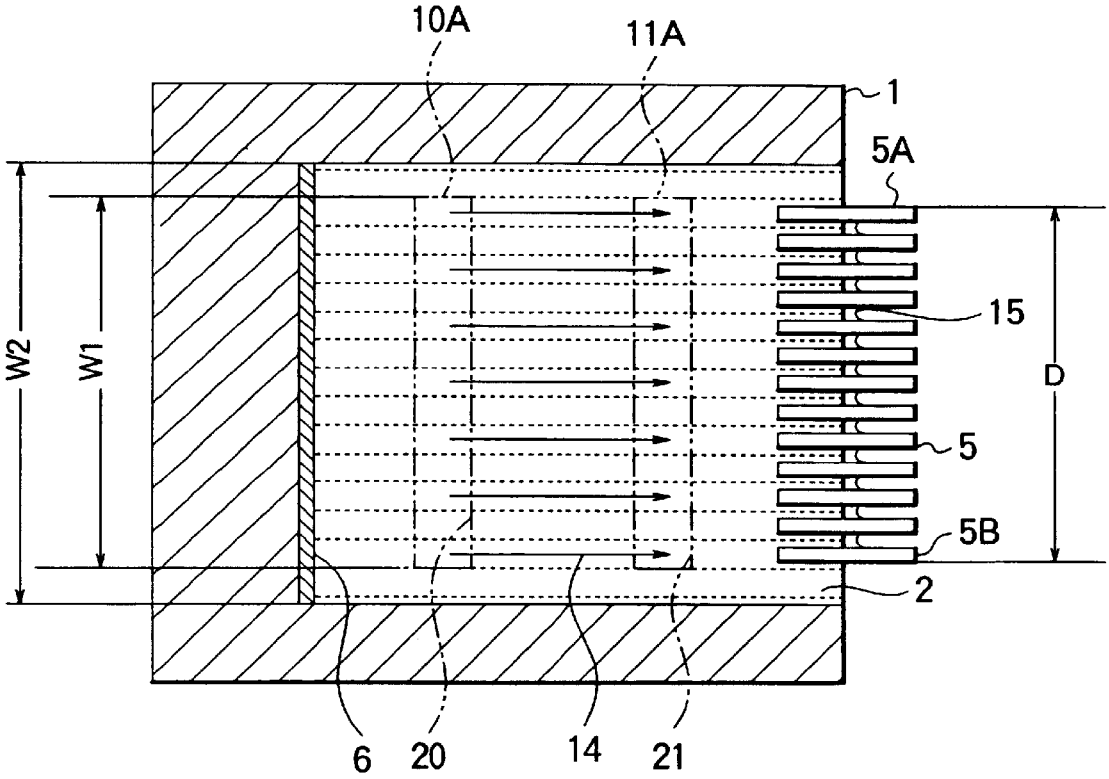
FIG. 4 is a schematic plan view of the head body of FIG. 2 for showing an ink flow in the ink chamber.

As illustrated in FIG. 4, both the ink inlet port 10A and the ink outlet port 11A have respective sides 20 and 21 near the ejection electrodes 5 which is parallel to the direction of the row of the chips of the ejection electrodes 5. In addition, both the ink outlet port 1A and the ink inlet port 10A have a width of W1 slightly greater than the distance of D between the outer edges of both the outermost ejection electrodes 5A and 5B.

Each of the ejection electrodes 5 projects slightly from the ink ejecting slit of the head body 1 toward the opposing electrode and has an insulating coat covering thereon. The electrophoretic electrode 6 extends between both sides of the ink chamber 2 at the rear end thereof, having a length W2 in the direction of the width of the ink chamber 2 larger than the distance D between the outer edges of both the outermost ejection electrodes 5A and 5B.

The ink reservoir 3 is disposed above the head body 1 to forward the liquid ink in the inlet tube 8 by gravity. The ink reservoir 3 receives therein a certain amount of liquid ink 13 which is adjusted before operation. It is preferable that the hydraulic head applied to the ink chamber 2 from the ink reservoir 3 be adjusted to an optimum value, which can be determined experimentally. The top of the ink reservoir 3 is provided with an air vent 12 which provides a communication between the interior of the ink reservoir 3 and the atmosphere. The liquid ink 13 in the head assembly contains charged toner particles made of colored thermoplastic resin dispersed within a petroleum derived organic solvent (e.g., isoparaffin) together with a charge controlling agent. The toner particles are apparently charged to the positive polarity by zeta-potential.

Figure 3:
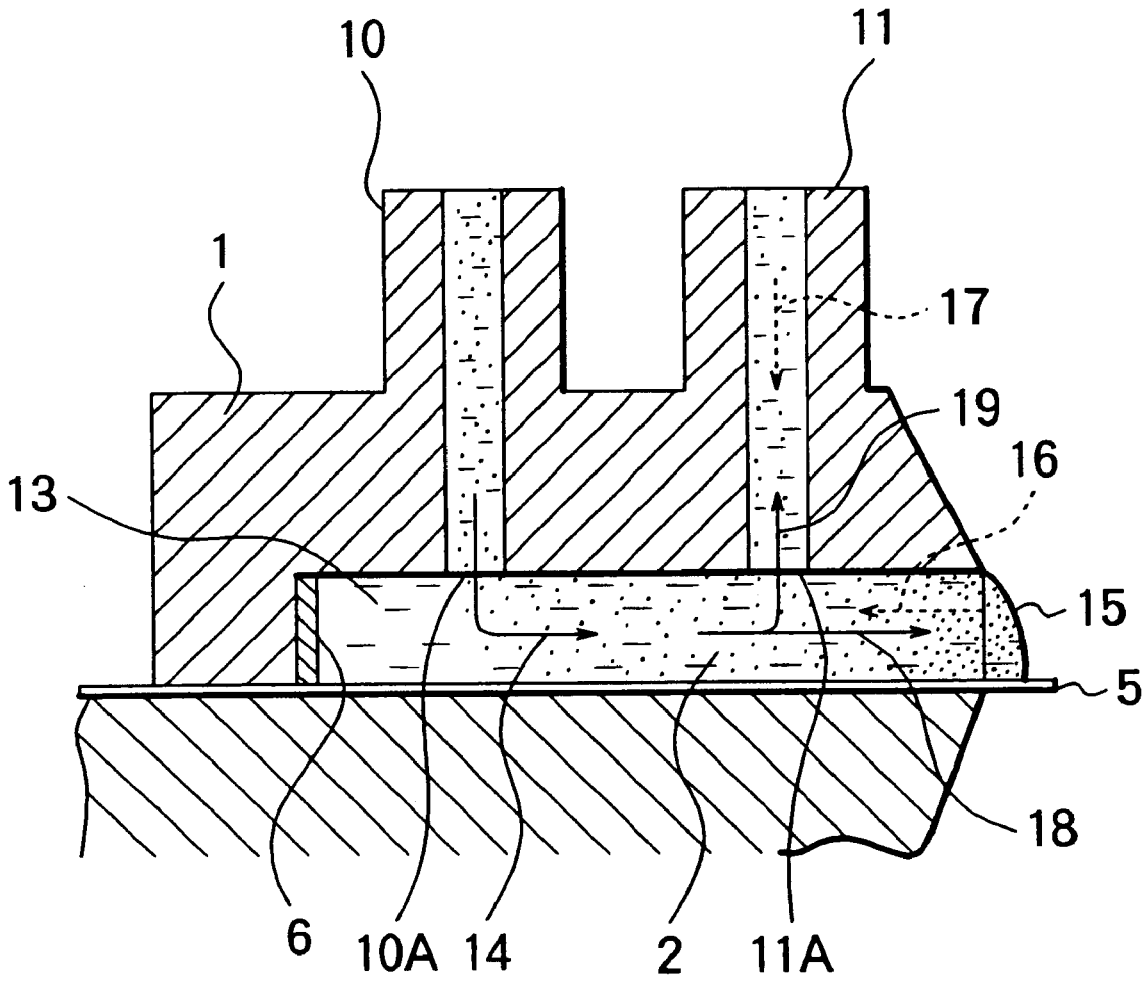
FIG. 3 is a detailed sectional view of the head body of FIG. 2 for showing an ink circulation in the ink chamber.

In operation, when a positive voltage, i.e., of the same polarity as the toner particles is applied to the electrophoretic electrode 6 in FIG. 3, the toner particles are driven by electrophoresis within the ink 13, and are concentrated at the ejecting portion 4, forming convex ink meniscuses 15 between adjacent ejection electrodes 5. When a voltage pulse of a designed magnitude and of the same polarity as the toner particles is applied to at least one of the ejection electrodes 5, the toner particles are ejected as a cluster from the ejecting portion 4. As a result of the ejection, the concentration of the toner particles in the vicinity of the ejecting portion 4 reduces, which is followed by replenishing of the toner particles from the other portion of the ink chamber under the influence of the electric field formed by the electrophoretic electrode 6.

Specifically, as the toner particles migrate by electrophoresis toward the ink ejection portion 4 under the influence of the electric field formed by the electrophoretic electrode 6, the migrating toner particles, as indicated by arrow 18, experience a frictional resistance from the surrounding solvent, which produces an ink flow in the surrounding solvent in a direction indicated by an arrow 14 in FIGS. 3 and 4. The ink flow allows the liquid ink 13 in the inlet tube 8 and connector 10 to be introduced through the ink inlet port 10A, and the ink 13 in the ink chamber 2 is forced out through the ink outlet port 11A as indicated by an arrow 19, because the flow resistance 17 against the ink disposed in the flow path from the ink outlet port 11A to the ink reservoir 3 is lower in magnitude than the ink meniscus force 16. In this manner, the liquid ink 13 is introduced into the ink chamber 2 through the inlet tube 8, then fed back to the ink reservoir 3 through the outlet tube 9, thereby producing a circulation of ink flow between the ink reservoir 3 and the ink chamber 2. The resulting ink circulation supplies toner particles from the ink reservoir 3 to the ink chamber 2.

By replenishing toner particles at any time, the ink jet recording head of the drop-on-demand type according to the embodiment can operate in a stable condition. No drive means such as a pump is necessary in the embodiment, and hence a compact size of the recording head and a reduction in manufacturing costs are obtained, without necessity of a pump maintenance. Since the flow resistance 17 against the ink disposed in the flow path from the ink outlet port 11A to the ink reservoir 3 is lower in magnitude than the ink meniscus force 16, an ink leakage from the ejecting portion 4 can be prevented which will otherwise occur due to the ink flow generated by the electrophoresis of the toner particles.

Since the ink outlet port 11A has a width larger than the distance between the outer edges of the outermost ejection electrodes, and since the ink outlet port 11A has a side parallel to the front edge of the head body near the ejection electrodes 5, the ink meniscus 15 formed at each ejection electrode 5 has a uniform shape as viewed in the direction of the row of the ejection electrodes 5, permitting a stabilized, uniform toner ejection to thereby improve the printing quality.

It is to be understood that at least one of the ink inlet port 10A and ink outlet port 11A may be divided and comprise a plurality of inlet port sections or outlet port sections which are disposed in an array in a direction parallel to the direction of the array of the tips of the ejection electrodes 5 or direction of the ejecting slit. In addition, the configuration of the inlet or outlet port may be circular or any other form.

Although the present invention is described with reference to preferred embodiment thereof, the present invention is not limited thereto and it will be apparent from those skilled in the art that various modifications or alterations can be easily made from the embodiment without departing from the scope of the present invention as set forth in the appended claims.

What is claimed is:

1. An ink jet recording head for ejecting liquid ink having charged toner particles comprising:

a head body;

an ink chamber in said head body for receiving a liquid ink containing a plurality of charged toner particles, said ink chamber having a front end, a rear end, an ink inlet port disposed adjacent said rear end, an ink outlet port disposed adjacent said front end, and an ink ejecting slit extending along the front end of said ink chamber;

a set of electrodes including (1) a plurality of ejection electrodes arranged within said ink chamber, said plurality of election electrodes having a plurality of tips along said ink electing slit for ejecting the plurality of charged toner particles from said ink chamber, (2) an electrophoretic electrode disposed within said ink chamber and (3) an opposing electrode disposed outside said ink chamber and opposed to said plurality of tips of said plurality of ejection electrodes, said ink inlet port disposed between said electrophoretic electrode and said plurality of tips of said plurality of ejection electrodes; and an ink reservoir, disposed above said ink chamber and connected to said ink inlet port and said ink outlet port, for providing the liquid ink by gravity to said ink chamber through said ink inlet port and for receiving the liquid ink from said ink chamber through said ink outlet port.

2. An ink jet recording head as defined in claim 1 wherein a flow resistance against the liquid ink in a flow path defined from said ink outlet port to said ink reservoir is smaller than a meniscus force provided by ink meniscuses formed at said ink ejecting slit.

3. An ink jet recording head as defined in claim 1 wherein said ink outlet port has a side larger than a distance between outer edges of both outermost ejection electrodes in a direction of said ink ejecting slit.

4. An ink jet recording head as defined in claim 1 wherein said ink outlet port has a side parallel to a direction of said ink ejecting slit.

* * * * *